US006439249B1

(12) United States Patent
Pan et al.

(10) Patent No.: US 6,439,249 B1
(45) Date of Patent: Aug. 27, 2002

(54) OUTDOOR UMBRELLA WITH LIGHTING ARRANGEMENT

(76) Inventors: Xing Yuan Pan; Wilson Linwei Weng, both of 6822 Milwood Ave., Suite 05, Canoga Park, CA (US) 91303

( * ) Notice: Subject to any disclaimer, the term of this patent is extended or adjusted under 35 U.S.C. 154(b) by 31 days.

(21) Appl. No.: 09/712,071

(22) Filed: Nov. 13, 2000

(30) Foreign Application Priority Data

Nov. 15, 1999 (CN) ..... 99124017

(51) Int. Cl.[7] ..... A45B 3/04

(52) U.S. Cl. ..... 135/16; 135/20.1; 135/98; 135/910; 362/102

(58) Field of Search ..... 135/16, 20.1, 21, 135/910, 98, 99, 90, 91; 362/102, 234, 249

(56) References Cited

U.S. PATENT DOCUMENTS 5,053,931 A * 10/1991 Rushing ..... 135/910
5,116,258 A * 5/1992 Vennik ..... 135/20.3
5,216,948 A * 6/1993 Sheppard et al. ..... 126/281
5,611,614 A * 3/1997 Morgan ..... 135/910
5,641,223 A * 6/1997 Rustebakke ..... 362/122
5,758,948 A * 6/1998 Hale ..... 362/123
6,089,727 A * 7/2000 Wu ..... 135/910
6,196,242 B1 * 3/2001 Xu ..... 135/20.1
6,217,192 B1 * 4/2001 Stratton ..... 362/249
6,270,230 B1 * 8/2001 Mai ..... 135/910

* cited by examiner

*Primary Examiner*—Carl D. Friedman
*Assistant Examiner*—Winnie Yip
(74) *Attorney, Agent, or Firm*—Raymond Y. Chan; David and Raymond Patent Group

(57) ABSTRACT

An outdoor umbrella with lighting arrangement includes a plurality of illuminating units each including an electrical extension mounted on a mounting slot of an awning tube of the outdoor umbrella and at least an illuminating connector having a replaceable illuminator mounted thereon electrically mounted on the electrical extension. The illuminating units are electrically connected together at an upper casing of the outdoor umbrella and electrically extended to a switchable power supply. So, when the outdoor umbrella is unfolded, the lighting arrangement is capable of illuminating an area under the outdoor umbrella.

14 Claims, 3 Drawing Sheets

OUTDOOR UMBRELLA WITH LIGHTING ARRANGEMENT

BACKGROUND OF THE PRESENT INVENTION

1. Field of Invention

The present invention relates to an outdoor umbrella, and more particularly to an outdoor umbrella with lighting arrangement integrally installed therein, wherein the lighting arrangement can illuminate an area under the outdoor umbrella.

2. Description of Related Arts

Outdoor umbrellas are usually provided in a campground or on a beach to give a pleasant shade for a user. In the dark, a user may merely mount a light on the outdoor umbrella for illumination. Conventionally, there are two installation methods in order to mount the light on the outdoor umbrella. First, the light is hanged on a supporting shaft of the outdoor umbrella. Second, the light is adhered on the supporting shaft of the outdoor umbrella. However, the two installation methods as mentioned above do not work when the outdoor umbrella is folded. Thus, when the light is installed into the outdoor umbrella, the outdoor umbrella is difficult to be folded up since the light may alter the origin structural design of the outdoor umbrella. Especially when the light is adhered on the outdoor umbrella, it is difficult for the user to maintain and repair the light since the light cannot be detached form the outdoor umbrella. Also, the external light will destroy the beauty appearance of the outdoor umbrella as well.

Moreover, such campground or beach may not provide any power source for providing electricity to the light. Even though there is a power source in such place, it is inconvenient for the user to extend an electrical cord from the light to the power source. The user may trip over the extending electrical cord which may cause accidents.

SUMMARY OF THE PRESENT INVENTION

A main object of the present invention is to provide an outdoor umbrella with lighting arrangement which is internally installed into the outdoor umbrella for well illuminating an area under the outdoor umbrella.

Another object of the present invention is to provide an outdoor umbrella with lighting arrangement which is easy to install to an existing outdoor umbrella and in low cost.

Another object of the present invention is to provide an outdoor umbrella with lighting arrangement wherein electrical cords and a switchable power supply are provided inside the outdoor umbrella such that a user is safe and hassle-free to operate the lighting arrangement.

Another object of the present invention is to provide an outdoor umbrella with lighting arrangement which can be equipped with an existing outdoor umbrella without any alteration of the outdoor umbrella.

Accordingly, in order to accomplish the above objects, the present invention provides an outdoor umbrella comprises an awning frame for supporting a fabric thereon and a lighting arrangement; wherein the awning frame comprises an upper casing, a lower casing, and a folding frame foldably connected between the upper casing and the lower casing wherein the folding frame comprises a plurality of hollow awning tubes radially extended from the upper casing and a plurality of hollow supporting bars each radially extended from the lower casing and rotatably connected to the respective awning tube, and a supporting frame for supporting the awning frame comprising a stand and a supporting shaft upwardly extended from the stand; and the lighting arrangement comprises a mounting slot longitudinally formed on each of the awning tubes, a plurality of illuminating units each comprising an electrical extension securely mounted along the mounting slot of the awning tube and at least an illuminating connector electrically connected to the electrical extension for mounting a replaceable illuminator wherein the illuminating units are electrically connected together at the upper casing and electrically extended to a switchable power supply provided in the supporting frame.

DETAILED DESCRIPTION OF THE PREFERRED EMBODIMENT

Figure 1:
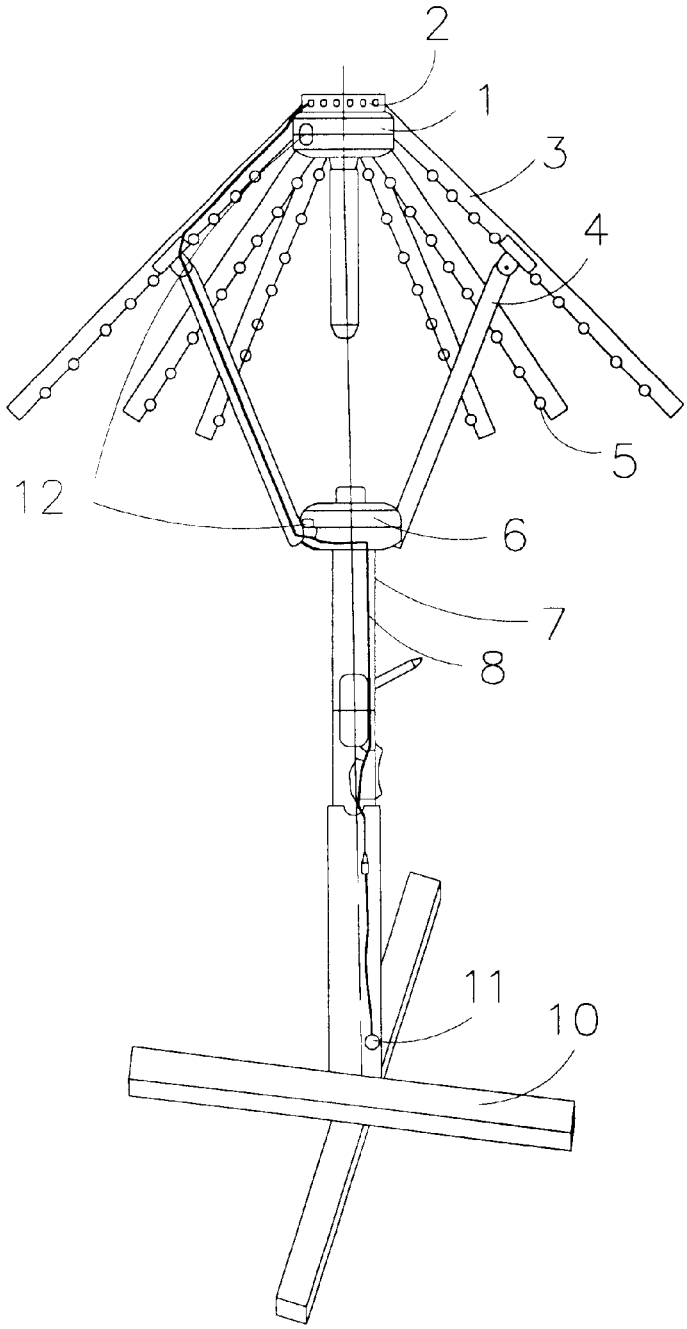
FIG. 1 is a sectional view of an outdoor umbrella with lighting arrangement according to a first preferred embodiment of the present invention.

Referring to FIG. 1 of the drawings, an outdoor umbrella according to a preferred embodiment of the present invention is illustrated, wherein the outdoor umbrella comprises an awning frame for supporting a fabric thereon and a lighting arrangement. The outdoor umbrella, such as a standard outdoor umbrella, comprises an upper casing 1 a lower casing 6, and a folding frame foldably connected between the upper casing 1 and lower casing 6 wherein the folding frame comprises a plurality of hollow awning tubes 3 radially extended from the upper casing 1 and a plurality of hollow supporting bars 4 each radially extended from the lower casing 6 and rotatably connected to the respective awning tube 3, and a supporting frame for supporting the awning frame comprising a stand 10 and a supporting shaft 7 upwardly and vertically extended from the stand 10.

The lighting arrangement comprises a mounting slot 32 longitudinally formed on each awning tube 3, a plurality of illuminating units each comprising an electrical extension 33 securely mounted along the mounting slot 32 of the awning tube 3 and an illuminating connector 31 spacedly provided along the electrical extension 33 for mounting a replaceable illuminator 5 wherein the illuminating units are electrically connected together at the upper casing 1 and electrically extended to a switchable power supply 11 provided in the supporting frame.

Figure 2:
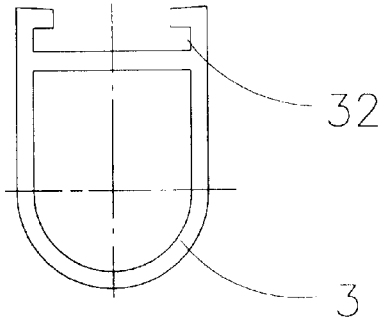
FIG. 2 is a sectional view of an awning tube of the outdoor umbrella with lighting arrangement according to the above first preferred embodiment of the present invention, illustrating a mounting slot formed on the awning tube.

Each mounting slot 32 is an elongated slot longitudinally formed along each awning tube 3, as shown in FIG. 2.

Figure 4:
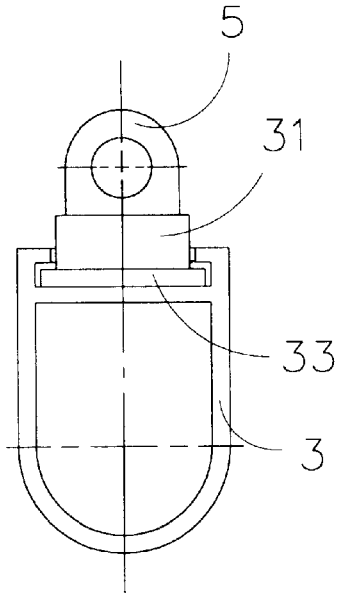
FIG. 4 illustrates an illuminating unit mounted on the awning tube of the outdoor umbrella according to the above first preferred embodiment of the present invention.
Figure 3:
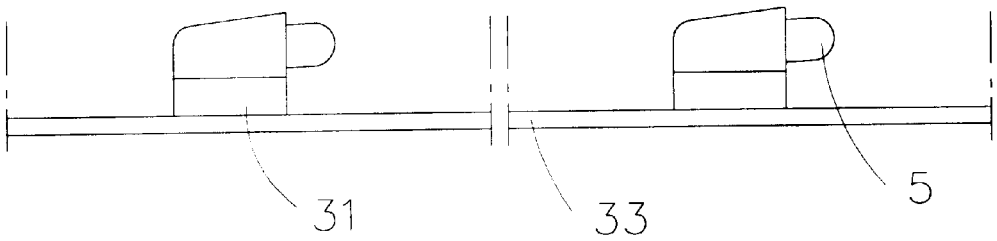
FIG. 3 illustrates an illuminating unit of the lighting arrangement for outdoor umbrella according to the above first preferred embodiment of the present invention.

Referring, to FIG. 3, the electrical extension 33 is an elongated belt adapted for securely mounting on the mounting slot 32 of the awning tube 3 wherein the illuminating connectors 31 are electrically connected together along the electrical extension 33 in such a manner that the replaceable illuminator 5, which is preferably a LED, is spacedly formed along each awning tube 3 when the electrical extension 33 is mounted on the mounting slot 32, as shown in FIG. 4. Alternatively, the replaceable illuminator 5 can be a regular light bulb so as to increase the brightness of the lighting arrangement for the outdoor umbrella.

The lighting arrangement further comprises a circuit board 2 provided in the upper casing 1 wherein the electrical extensions 33 of the illuminating units are electrically connected to the circuit board 2 at the upper casing 1.

According to a first preferred embodiment, the outdoor umbrella is an upright type of outdoor umbrella wherein the lower casing 6 is mounted on top of the supporting shaft 7 of the supporting frame.

An electrical wire 8 is electrically extended from the circuit board 2 to the switchable power supply 11 wherein the electrical wire 8 is passing through the hollow awning tube 3, the hollow supporting bar 4, and the hollow supporting shaft 7 respectively to the switchable power supply 11, as shown in FIG. 1. The switchable power supply 11 is adapted for not only supplying electricity to the lighting arrangement but also selectively switching the lighting arrangement on and off. The switchable power supply 11 can be a rechargeable battery with DC current such that no additional wire extension is needed for electrically connecting to an external power supply. Alternatively, the switchable power supply 11 can be extended to a power source with AC current by an extension power cord.

The lighting arrangement further comprises an auto switching device 12 provided in the lower casing 6 wherein the auto switching device 12 are electrically connected with the electric wire 8 respectively so as to switch the light arrangement on and off. The auto switching device 12 is adapted for automatically switching on and off the illuminating units by a folding motion of the outdoor umbrella. In other words, when the outdoor umbrella is in an unfolded position, the illuminators 5 are automatically turned on. Otherwise, when the outdoor umbrella is folded up, the illuminators 5 are automatically turned off. Alternatively, the auto switching device 12 can be mounted in the upper casing and electrically connected with the circuit board 2 to achieve the same function of automatically switching on and off of the lighting arrangement.

Figure 5:
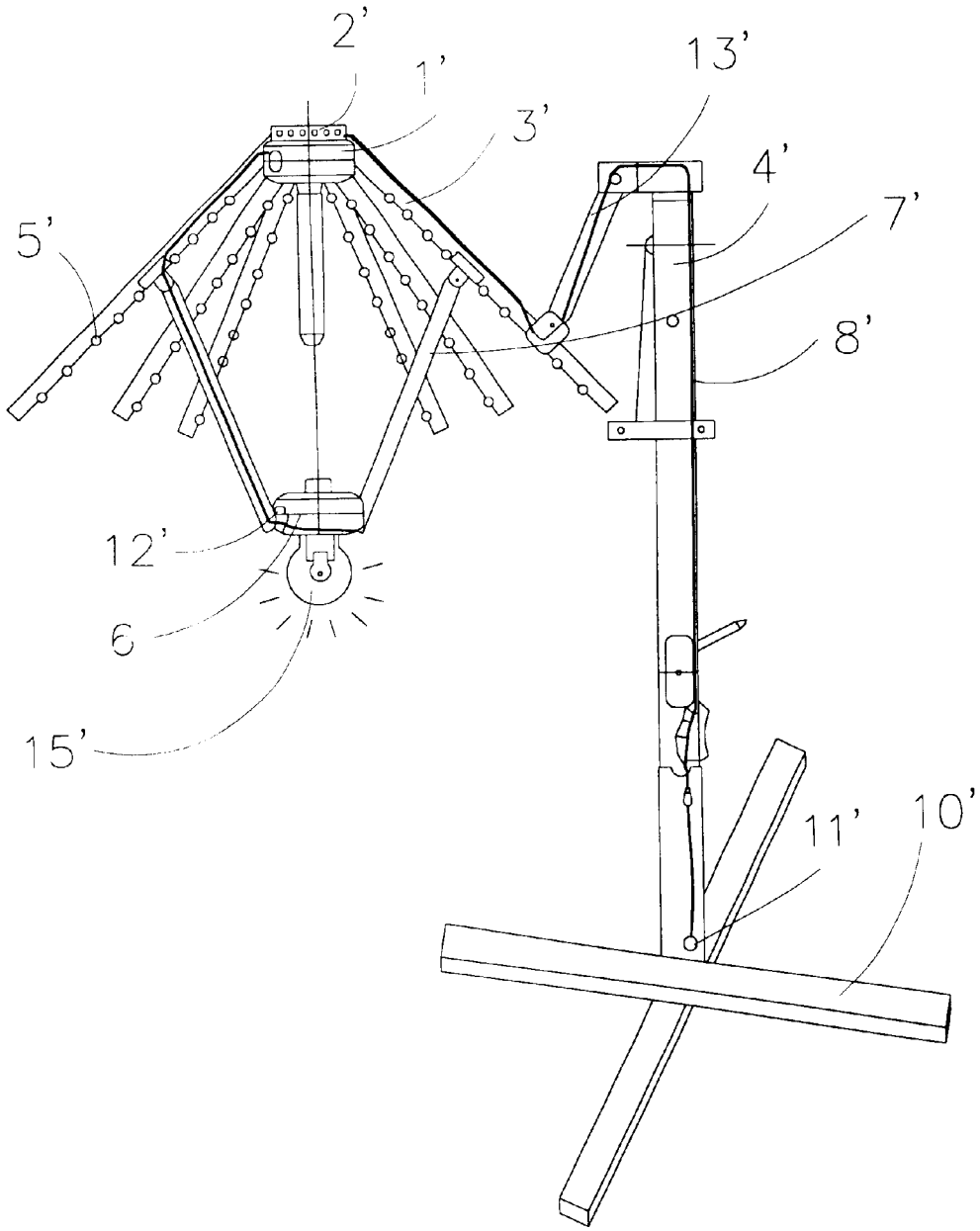
FIG. 5 is a sectional view of an outdoor umbrella with lighting arrangement according to a second preferred embodiment of the present invention.

Referring to FIG. 5, an outdoor umbrella with lighting arrangement according to a second embodiment is illustrated, which is an alternative mode of the outdoor umbrella of the first embodiment. The supporting frame further comprises a supporting arm 13' foldably extended from the top of the supporting shaft 7' and pivotally connected to one of the awning tube 3' such that the awning frame is suspendedly supported by the supporting frame.

According to the second embodiment, since the structure of the outdoor umbrella is slightly different from it first embodiment, the electrical wire 8' is detoured to electrically connected to the switchable power supply 11'. The electrical wire 8' is electrically extended between the circuit board 2' at the upper casing 1' to the switchable power supply 11' in the supporting frame wherein the electrical wire 8' is passing through one of the awning tube 3' to the supporting shaft 7' through the supporting arm 13'.

The lighting arrangement further comprises a replaceable light bulb 15' mounted underneath the lower casing 6' of the awning frame, as shown in FIG. 4, wherein the light bulb 15' is electrically connected to the circuit board 2' by an elongated wire extending through the supporting bar 4' and the awning tube 3' respectively. Also, the lighting arrangement further comprises an auto switching device 12' provided in the lower casing 6' wherein the auto switching device 12' are electrically connected with the electric wire 8' respectively so as to automatically switch the light arrangement on and off.

In order to reduce the cost of the present invention, the lighting arrangement comprises the light bulb 15' mounted underneath the lower casing 6' of the awning frame wherein the electric wire 8' is directly connected between the light bulb 8' and the switchable power supply 11'. Thus, the auto switch device 12' are respectively mounted inside the supporting shaft 7' and the lower casing 6' for switching the on and off the lighting arrangement, as mentioned above. It is worth to mention that the light bulb 15' preferably has higher watts so as to provide a better illumination for the outdoor umbrella.

What is claimed is:

1. An outdoor umbrella, comprising an awning frame supporting a fabric thereon and a lighting arrangement; wherein said awning frame comprises an upper casing, a lower casing, and a folding frame foldably connected between said upper casing and said lower casing wherein said folding frame comprises a plurality of hollow awning tubes radially extended from said upper casing and a plurality of hollow supporting bars each radially extended from said lower casing and rotatably connected to said respective awning tube, and a supporting frame for supporting said awning frame comprising a stand and a hollow supporting shaft upwardly extended from said stand; and said lighting arrangement comprises a mounting slot longitudinally formed on each of said awning tubes, a plurality of illuminating units each comprising a electrical extension securely mounted along said mounting slot of said awning tube respectively and illuminating connectors electrically connected to said electrical extension for mounting replaceable illuminators wherein said illuminating units are electrically connected together at said upper casing and electrically extended to a switchable power supply provided in said supporting frame.

2. An outdoor umbrella, as recited in claim 1, wherein said lighting arrangement further comprises a circuit board mounted in said upper casing in such a manner that said illuminating units are electrically connected to said circuit board, and an electric wire electrically extended from said circuit board to said switchable power supply, so as to electrically connect said illuminating units with said switchable power supply.

3. An outdoor umbrella, as recited in claim 2, wherein said lighting arrangement further comprises an auto switching device, which is provided in said lower casing and electrically connected with said illuminating units, is adapted for automatically switching on and off said illuminating units by a folding motion of said outdoor umbrella.

4. An outdoor umbrella, as recited in claim 3, wherein said electric wire is passing from said circuit board through said hollow awning tube, said hollow supporting bar, and said hollow supporting shaft respectively to said switchable power supply.

5. An outdoor umbrella, as recited in claim 4, wherein said illuminator is a LED.

6. An outdoor umbrella, as recited in claim 4, wherein said illuminator is a light bulb.

7. An outdoor umbrella, as recited in claim 3, wherein said outdoor umbrella further comprises a hollow supporting arm foldably extended from a top of said supporting shaft to said awning frame wherein said electric wire is passing from said circuit board through said hollow awning tube, said hollow supporting arm, and said hollow supporting shaft respectively to said switchable power supply.

8. An outdoor umbrella, as recited in claim 7, wherein said lighting arrangement further comprises a light bulb mounted underneath said lower casing wherein said light bulb is electrically connected to said circuit board through said folding frame.

9. An outdoor umbrella, as recited in claim 8, wherein said illuminator is a light bulb.

10. An outdoor umbrella, as recited in claim 7, wherein said illuminator is a LED.

11. An outdoor umbrella, as recited in claim 2, wherein said electric wire is passing from said circuit board through said hollow awning tube, said hollow supporting bar, and said hollow supporting shaft respectively to said switchable power supply.

12. An outdoor umbrella, as recited in claim 2, wherein said outdoor umbrella further comprises a hollow supporting arm foldably extended from a top of said supporting shaft to said awning frame wherein said electric wire is passing from said circuit board through said hollow awning tube, said hollow supporting arm, and said hollow supporting shaft respectively to said switchable power supply.

13. An outdoor umbrella, as recited in claim 12, wherein said lighting arrangement further comprises a light bulb mounted underneath said lower casing wherein said light bulb is electrically connected to said circuit board through said-folding frame.

14. An outdoor umbrella, as recited in claim 1, wherein said lighting arrangement further comprises an auto switching device, which is provided in said lower casing and electrically connected with said illuminating units, is adapted for automatically switching on and off said illuminating units by a folding motion of said outdoor umbrella.

* * * * *